US007987794B2

(12) United States Patent
Grenon

(10) Patent No.: US 7,987,794 B2
(45) Date of Patent: Aug. 2, 2011

(54) SIDE SHIFT RAISE CLIMBING SYSTEM

(75) Inventor: Randy E. Grenon, Sudbury (CA)

(73) Assignee: J. S. Redpath Limited, North Bay (CA)

( * ) Notice: Subject to any disclaimer, the term of this patent is extended or adjusted under 35 U.S.C. 154(b) by 350 days.

(21) Appl. No.: 12/209,010

(22) Filed: Sep. 11, 2008

(65) Prior Publication Data

US 2009/0071364 A1 Mar. 19, 2009

Related U.S. Application Data

(60) Provisional application No. 60/972,380, filed on Sep. 14, 2007.

(51) Int. Cl.
*B61B 12/02* (2006.01)

(52) U.S. Cl. ..... 104/96

(58) Field of Classification Search ..... 104/48, 104/89–91, 96–98, 127, 102; 105/148; 182/82–84, 182/112, 128; 187/245, 414
See application file for complete search history.

(56) References Cited

U.S. PATENT DOCUMENTS 2,316,223 A * 4/1943 Cheneau ..... 105/30
3,378,106 A * 4/1968 Wegner ..... 187/414
3,731,976 A 5/1973 Granskog et al.
3,830,338 A * 8/1974 Svensson ..... 182/82
4,037,537 A 7/1977 Thorsell et al.
4,132,276 A 1/1979 Svensson
4,456,097 A 6/1984 Salihi
6,626,267 B2 9/2003 Beus et al.

FOREIGN PATENT DOCUMENTS

GB 1302802 6/1966
WO WO 99/24695 A1 5/1999

OTHER PUBLICATIONS

Alimak—Raise Climbers for Mining and Underground Engineering; Obtained online Apr. 2007.
Thomas, C.; Search Report from corresponding PCT Application No. PCT/CA2008/001602; Jan. 20, 2009.

* cited by examiner

*Primary Examiner* — Joe Morano, IV
*Assistant Examiner* — R. J. McCarry, Jr.
(74) *Attorney, Agent, or Firm* — Brett J. Slaney; Blake, Cassels & Graydon LLP

(57) ABSTRACT

A side-shift raise climbing system is provided that utilizes a side-cut excavated into the wall of the access drift for a raise in a mine. A transfer section is incorporated into the existing length of rail servicing the raise. The transfer section includes a laterally transferable rail that can be detached from the existing rail and shifted along a set of monorails that extend into the side-cut. The transfer section enables a raise climber, when parked thereon, to be shifted out of the access drift without requiring additional access drifts or parking/nesting areas to accommodate the use of muck removal equipment.

16 Claims, 11 Drawing Sheets

SIDE SHIFT RAISE CLIMBING SYSTEM

This application claims priority from U.S. Application No. 60/972,380 filed on Sep. 14, 2007, the contents of which are incorporated herein by reference.

FIELD OF THE INVENTION

The present invention relates to raise climbing systems.

BACKGROUND

It is sometimes required in an underground mine, to provide access from a lower level L thereof to an upper level U thereof, as shown in FIG. 1. A mine owner may request that a raise excavation R be created from the lower level L to the upper level U, which is of a certain size/configuration and length. The raise R may be used to serve a variety of purposes such as air ventilation, secondary personnel access/egress or as material dump chutes.

To create the raise excavation R, a pilot or access drift A is first excavated from the main mine drift D to the proposed raise location. This provides access to the raise R for both personnel and muck removal equipment (not shown). As can be seen in FIGS. 1 and 2, a muck pile M typically forms at the bottom of the raise R as it is being excavated.

An additional excavation N is typically made into the pilot or access drift A immediately adjacent to the raise location, to install a docking nest or parking area P for raise climbing equipment commonly referred to as a 'raise climber' or raise climbing system and denoted herein by numeral 10. The raise climber 10 travels along a rail 12 and is used to start and muck the raise excavation R as is well known in the art. As the raise R is excavated, muck piles M accumulate at the bottom of the raise R and are then removed. The additional excavation N enables the raise climber 10 to retreat into the access drift A and avoid contact with the falling debris.

To assist personnel in loading/unloading and entering/exiting the raise climber 10, a suspended deck, typically made of timber is hung at the proposed parking area P. The decking can be suspended using a series of chains/turnbuckles or other devices. The lower level of the access drift A is then clear for access by the mucking equipment so that the material can be removed as required. The parking area P can also be used by personnel to load supplies and to move into and out of the site.

A typical process for excavating a raise R includes driving the raise climber 10 to the face of the raise R, drilling a round of holes, loading the holes with explosives, returning to the parking area P, detonating the explosives, clearing the muck, adding rail 12 as necessary, and repeating until the raise R reaches the upper level U.

Problems with traditional parking areas P at raise excavation sites, e.g. as shown in FIG. 2, is that it is, i) often considered costly to excavate; ii) cannot typically be reused for any beneficial purpose once the raise R has been excavated; and iii) due to the relatively large excavation required, there is an added measure of instability in the parking area P that needs to be rectified with additional rock stabilization methods. As such, this upper area (excavation) N not only increases effort and cost required to prepare the access drift A for the raise R, it has little or no value after the raise excavation is finished.

Another problem is that, although moving the raise climber 10 into the additional excavation N and above the parking area P removes the raise climber 10 from the direct path of the falling debris accumulating in the muck pile M, both the raise climber 10 and the decking timber may still interfere with the muck removal equipment and would require regular maintenance and repairs. The elevated work platform also introduces safety concerns as access for workers and materials is provided via a ladder way. The raise end of the platform has limited protection as the raise climber 10 traverses the area on its way to and from the raise R.

It is therefore an object of the following to address the above-noted disadvantages.

SUMMARY OF THE INVENTION

It has been found that to avoid the added instability, expense and effort associated with the additional excavation N, and to avoid the additional cost of the timber, hanging rods and ladder access required to install a parking area P used in the prior art; a lateral excavation or "side-cut" can be excavated into a side wall of the pilot or access drift A and a transfer rail system used to move the raise climber aside when not in use. In this way, clearance can be made for mucking equipment and the raise climber can be safely stowed during blasting.

In one aspect, there is provided a transfer assembly for transferring a raise climber out of an access drift, the transfer assembly comprising: a modified rail being sized to fit in alignment with an existing rail and to provide continuity therebetween for permitting the raise climber to drive from the modified rail onto the existing rail; one or more supports attached to and extending upwardly from the modified rail and positioned along the modified rail to be aligned with corresponding transfer rails extending from the access drift into a side-cut in the access drift; and a trolley at an upper end of each support, each support sized to provide vertical alignment of the trolley with a corresponding transfer rail when the transfer assembly is aligned with the existing raise climber rail, each trolley configured to suspend from and be moveable along the corresponding transfer rail to permit movement of the transfer assembly laterally with respect to the existing rail and into the side-cut.

In another aspect, there is provided a method for modifying an access drift in a mine to incorporate a parking area for a raise climber, the method comprising: installing in a side-cut in the access drift, one or more transfer rails extending from an existing rail for the raise climber into the side-cut; providing a modified rail sized to fit in alignment with the existing rail and to provide continuity therebetween for permitting the raise climber to drive from the modified rail onto the existing rail; providing one or more supports extending upwardly from the modified rail and positioned along the modified rail to be aligned with corresponding transfer rails; providing a trolley on each support, each trolley configured to suspend from and be moveable along the corresponding transfer rail; and suspending the modified rail from the transfer rails by suspending each trolley from a corresponding transfer rail.

BRIEF DESCRIPTION OF THE DRAWINGS

An embodiment of the invention will now be described by way of example only with reference to the appended drawings wherein.

DETAILED DESCRIPTION OF THE DRAWINGS

Figure 3:
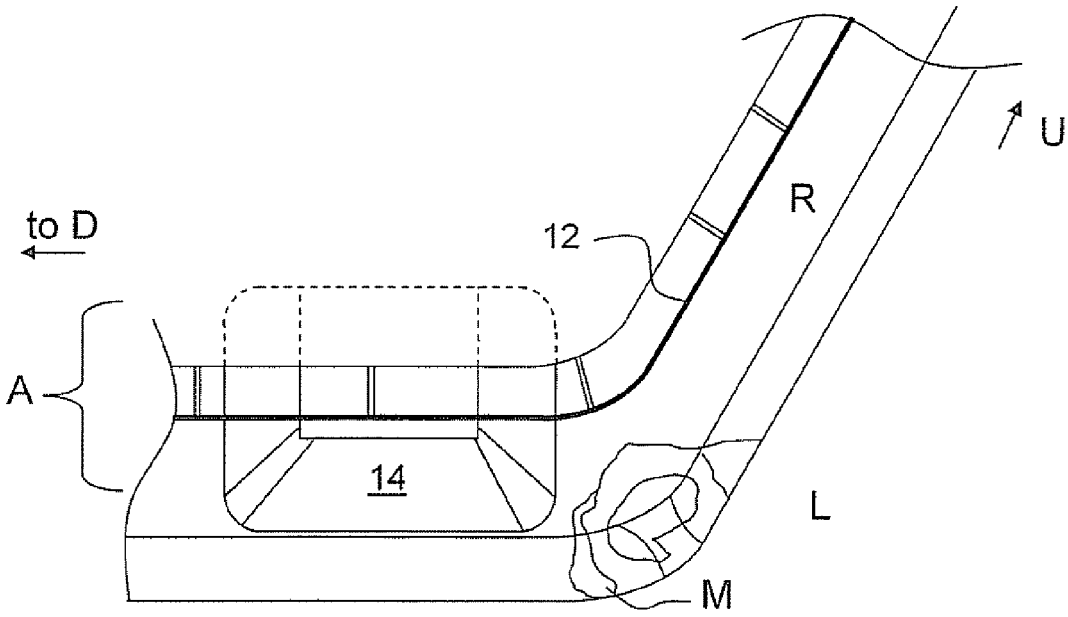
FIG. 3 is a schematic diagram showing a side-shift nesting station for a raise climber.

Referring now to FIG. 3, to avoid the added instability, cost and time associated with the additional excavation N, and to avoid the additional cost of the timber, hanging rods and ladder access required to install a parking area P used in the prior art; in the following system, a side-cut 14 is excavated into a side wall of the pilot or access drift A.

Not only are the costs and additional materials associated with the prior art configuration shown in FIG. 1 avoided during excavation of the raise R, but the side-cut 14 can be reused at a later time for electrical services, equipment storage, shelter etc. Moreover, the instability created by further excavation of the access drift A is avoided. Further still, the side-cut 14 enables a raise climber 10 to be shifted out of the access drift A and in turn out of the way of mucking equipment, avoiding the need for another drift in order to access the bottom of the raise R for muck removal. As such, the side-cut 14 is particularly suitable for mine environments such as those shown in FIG. 1-3 where only a single access drift A is used to provide access to the raise R.

Figure 5:
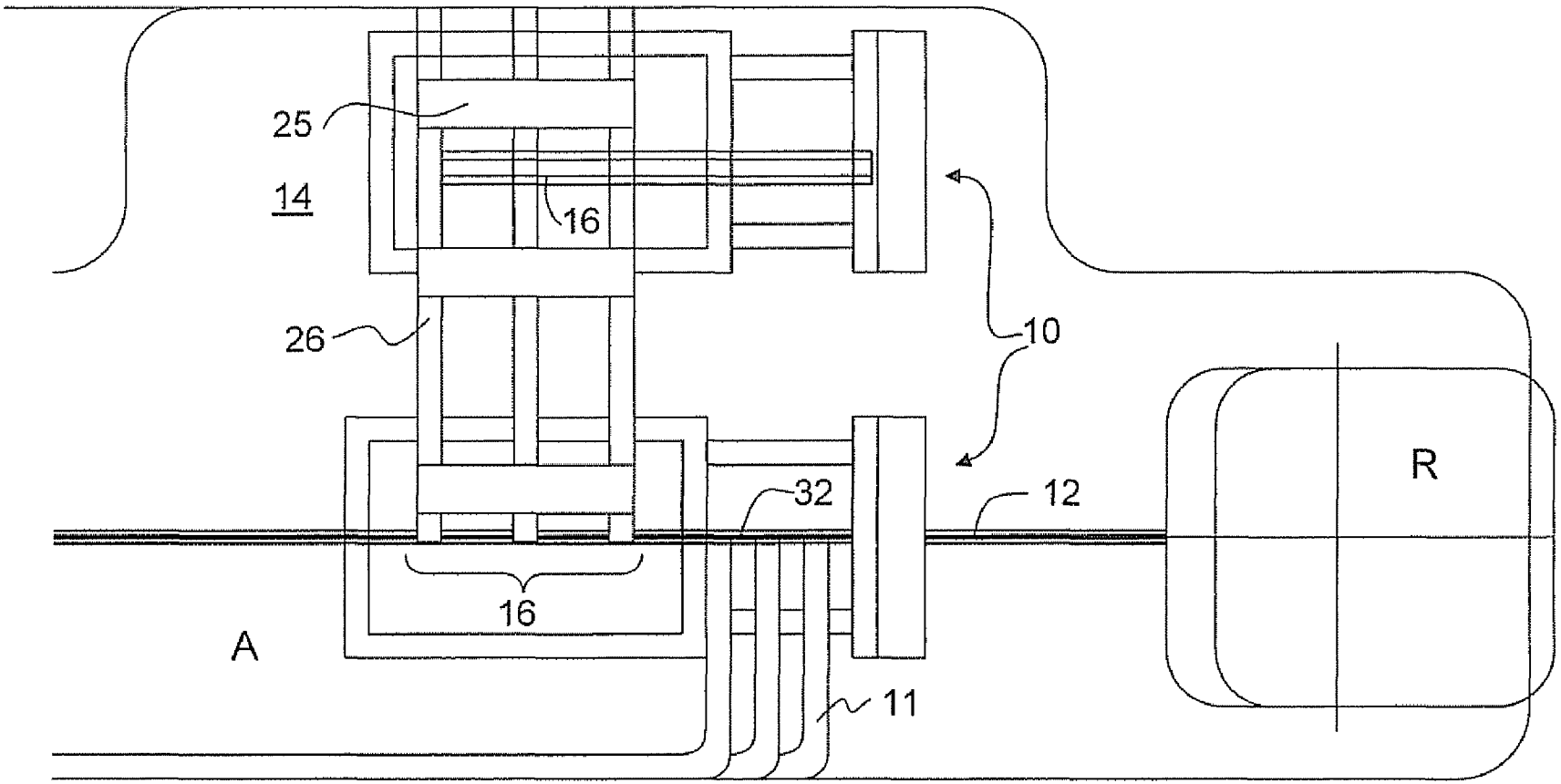
FIG. 5 is a plan view of the nesting station shown in FIG. 4.

The side-cut 14 is excavated into the side wall of the pilot or access drift A prior to starting the raise R, to a depth that preferably can entirely contain the raise climber 10 as best seen in FIG. 5. The side-cut 14 is also preferably stabilized once it has been cut, in a manner similar to the surrounding drift A. Since the side-cut 14 enables the raise climber 10 to hang much closer to the floor of the drift A than previous parking areas P, the raise climber 10 can be loaded directly from a more accessible platform supported on the floor of the drift A or the floor itself without requiring a ladder to access the equipment. The side-cut 14 can be excavated at any desired position along the drift A and is typically excavated at a similar position as where the traditional timber decking would hang.

Figure 4:
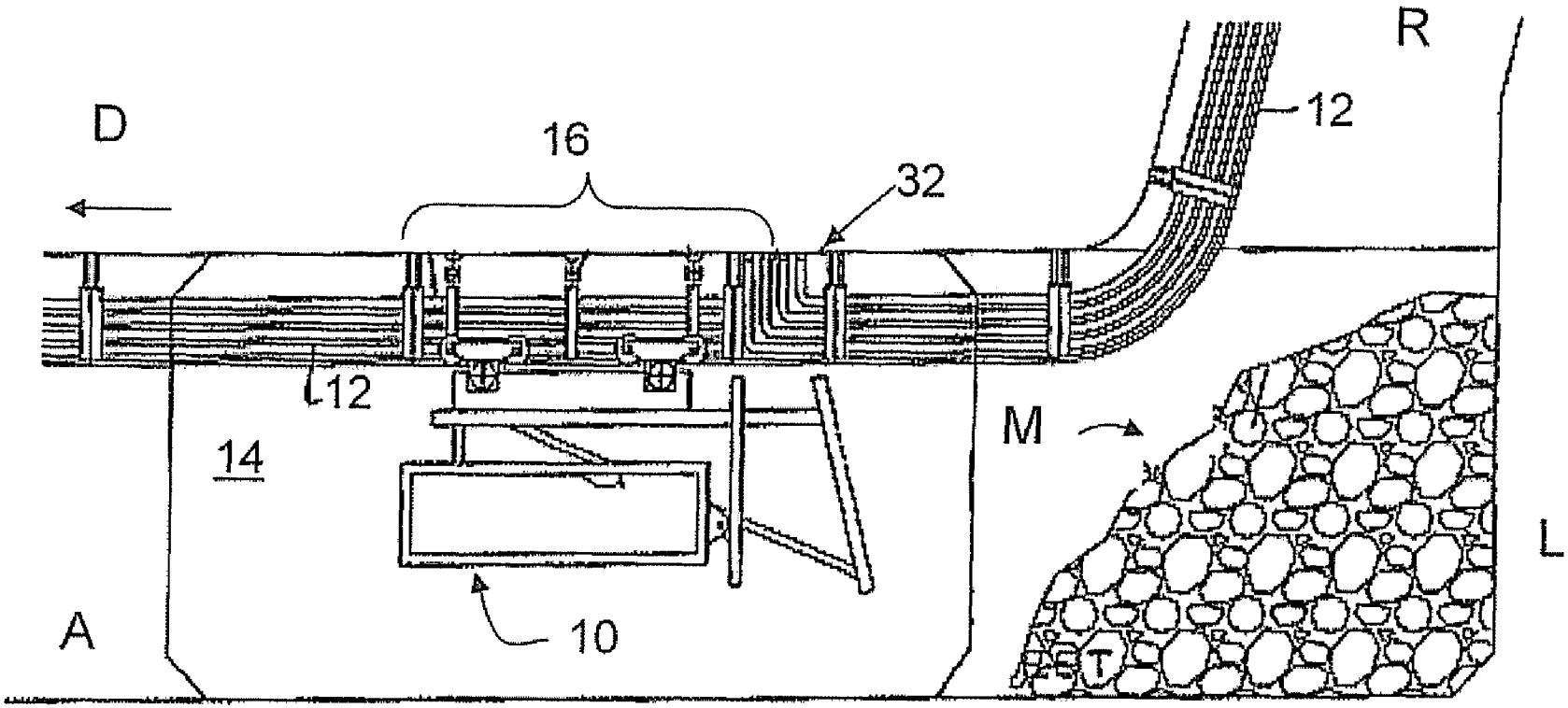
FIG. 4 is an enlarged view of the nesting station of FIG. 3.

In order to utilize the side-cut 14 for docking the raise climber 10, a section of the rail 12 is replaced at a position adjacent the side-cut 14, with a transfer assembly or transfer section 16 as shown in FIGS. 4 and 5. The transfer section 16 enables existing rail 12 and an existing raise climber 10 to be used with the side-cut 14 while avoiding the need for a suspended timber decking and ladder and the additional excavation N required to accommodate such decking.

As can be seen schematically in FIG. 5, the transfer section 16 can move between a first position in alignment with the existing rail 12 and a second position within the side-cut 14 along a set of corresponding, laterally extending transfer rails 26. To provide stability for the transfer rails 26, one or more crossbeams 25 may be attached to and span the set of transfer rails 26 as exemplified in FIG. 5. It will be appreciated that, as discussed below, each transfer rail 26 is preferably rock bolted to the ceiling of the side-cut 14, commonly referred to as the 'back', and thus the crossbeams 25 may only be required for additional stability. Also, one, two or greater than three crossbeams 25 can be used as desired. Similarly, fewer or greater than three transfer rails 26 can be used, depending on the overall stability of the existing rails 12, the size of the raise climber 10 and other factors specific to the jobsite and application. Stability may also be provided using variations of the above-noted examples. For example, the outside transfer rails 26 can be rock bolted and the middle transfer rail 26 secured thereto using only the crossbeams 25. As such, it can be seen that the transfer rails 26 can be adapted to suit any requirements of the jobsite and equipment being used. As will be discussed in greater detail below, the transfer section 16 inherently disrupts the continuity of services that are traditionally supplied through the rails 12, since it can be moved out of alignment with the existing rails 12. As shown in FIG. 5, the services can be redirected to a service header 32 positioned between the transfer section 16 and the raise-side of the existing rail 12 using a series of pipes 11 or similar hoses or other connections as needed.

Figure 6:
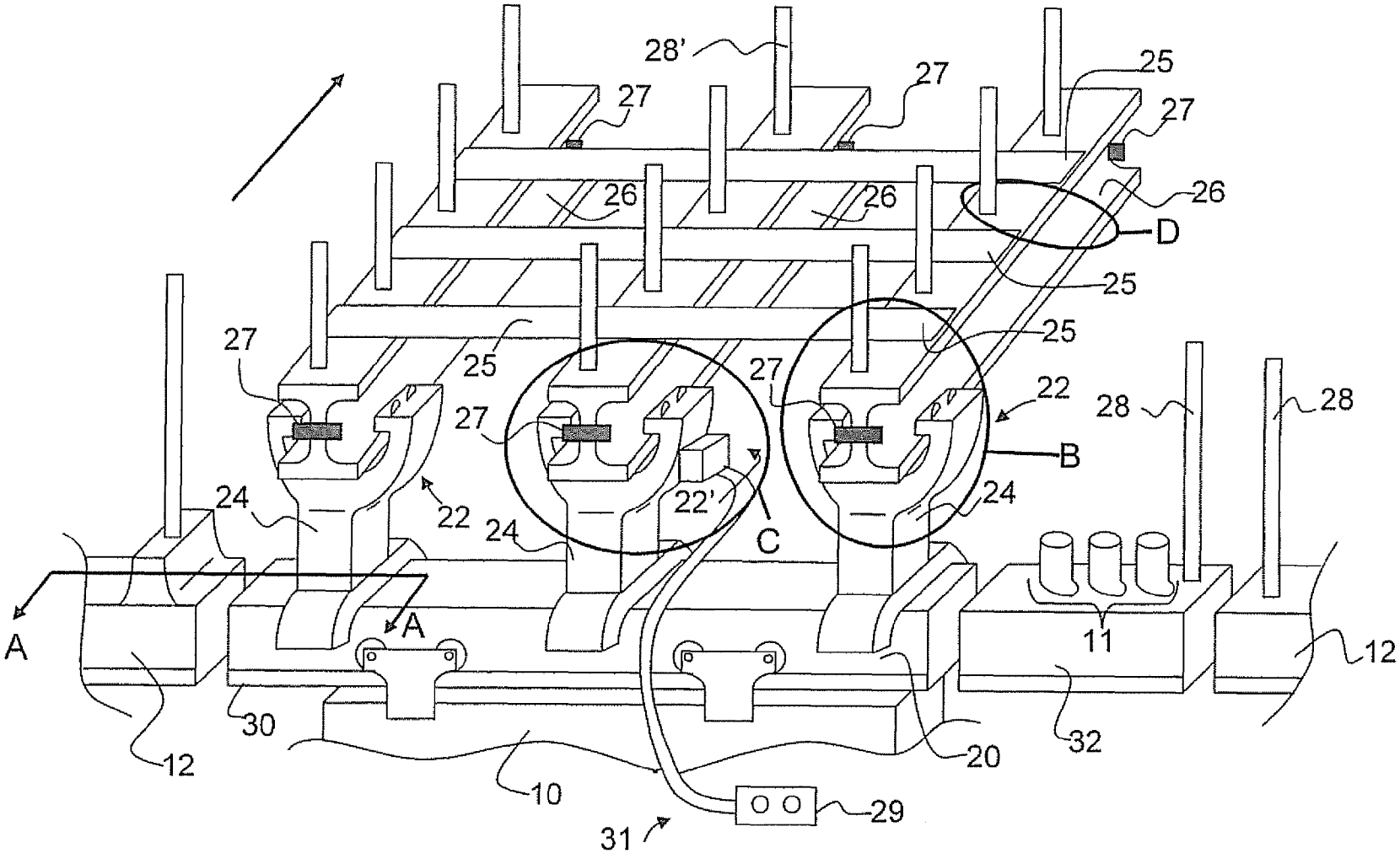
FIG. 6 is a perspective view of a set of side-shift rails and a trolley and transfer section.

The transfer section 16 and transfer rails 26 are shown in greater detail in FIG. 6. It will be appreciated that the proportions in FIG. 6 are exaggerated for ease of illustration. The transfer section 16 includes a modified climber rail 20 that is suspended below one or more trolleys 22 using corresponding supports 24. The trolleys 22 are configured to hang from and slide over corresponding ones of the transfer rails 26 that are oriented perpendicular to the rail 12 and perpendicular to the modified rail 20 such that they extend into the side-cut 14. As shown by way of example only in FIG. 6, the transfer rails 26 may be constructed from steel I-beams, which provide a pair of opposite tracks on which the trolleys 22 can travel. The trolleys 22 are secured to the supports 24, which in turn are secured to the modified climber rail 20. In this example, the outer transfer rails 26 support non-powered trolleys 22 while the middle transfer rail 26 supports a powered trolley 22'. The powered trolley 22' comprises a drive system (explained below) which in this example is powered by an air supply system 31 and controlled using a control box 29. It will be appreciated that any suitable drive system can be used and the air supplied drive system described herein is for illustrative purposes only. It may be noted however that an air supplied system is particularly convenient due to the existing air services typically installed in the access drift A for other purposes such as driving the raise climber 10.

The trolleys 22, 22', the supports 24 and the modified rail 20 can be secured using any suitable fasteners such as bolts or rivets or may instead be welded together. Examples of such attachment will be described in detail below. Preferably, the components of the transfer 6 section 16 are removably securable to each other (e.g. using bolts) to facilitate installation, removal and maintenance of the transfer section 16. It will be appreciated that although only one trolley 22 is required (e.g. the middle drive trolley 22'), more than one trolley 22 is preferable for added stability, and it has been found that a set of three trolleys 22 is suitable.

As noted above, the transfer rails 26 may be rock bolted to the back of the side-cut 14 and this may be done using one or more rock bolts 28 attached to the transfer rails 26 and suspended from the back of the side-cut 14. The rock bolts 28 can be similar to the rock bolt 28 used to suspend the rail 12. In FIG. 6, four rock bolt assemblies 28' are shown, however, it will be appreciated that any number of rock bolt assemblies 28' can be used. The transfer rails 26 are also preferably rock bolted at the far end to the innermost wall of the side-cut 14. To inhibit movement of the transfer section 16 off of the transfer rails 26, each transfer rail 26 may include a stopper 27 at one or both ends, in this example using a plate welded to the I-beams at each end. It can also be seen in FIG. 6 that the crossbeams 25 are advantageously attached across the tops of the transfer rails 16 so as to not interfere with movement of the trolleys 22, 22'.

Figure 7:
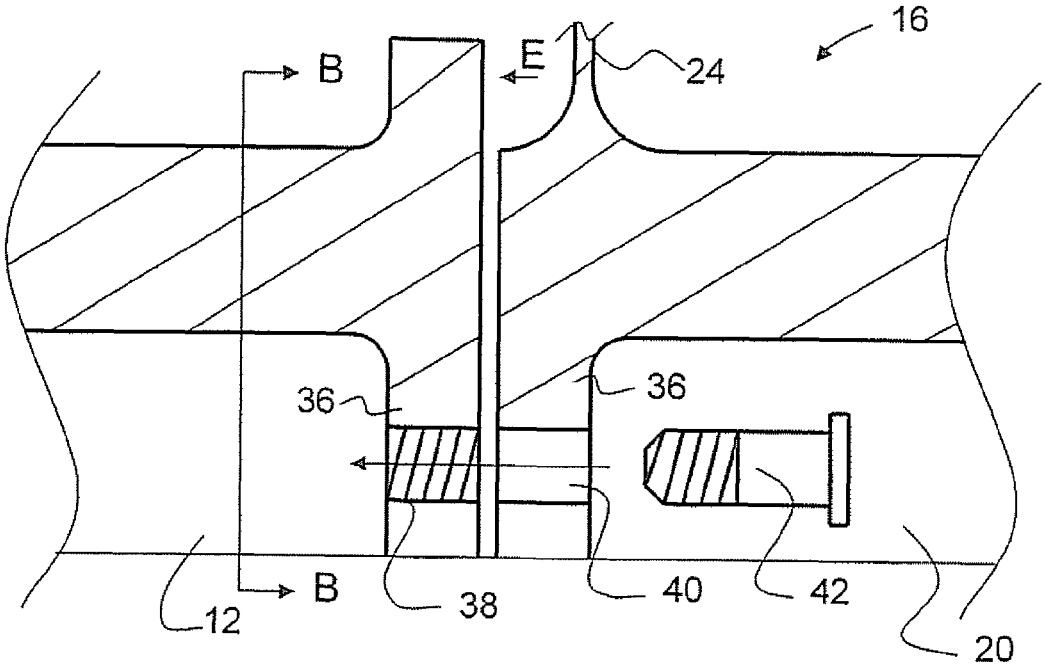
FIG. 7 is a sectional view along the line A-A of FIG. 6.
Figure 8:
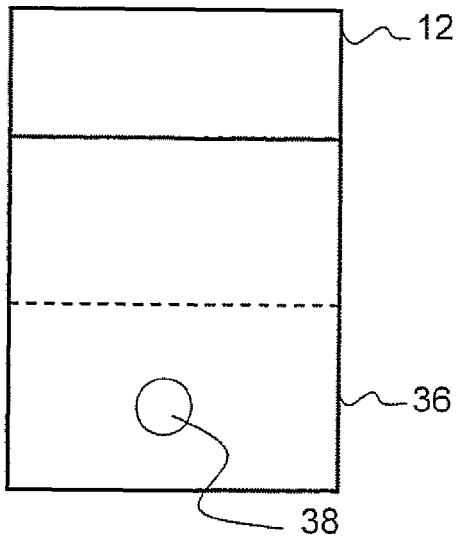
FIG. 8 is an end view along line E of FIG. 7.
Figure 9:
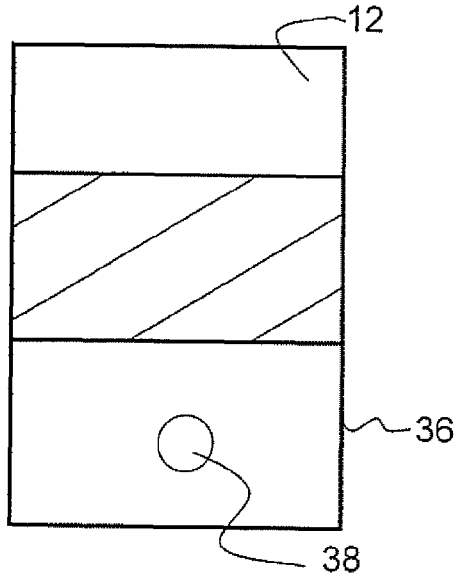
FIG. 9 is a sectional view along the line B-B of FIG. 7.

The modified transfer rail 20 includes the usual drive track 30 that interacts with the raise climber's drive sprocket (not shown). As shown in FIGS. 7-9, to maintain alignment of the drive track 30 with the drive track 30 of preceding and subsequent lengths of rail 12, the transfer rail 20 is secured to the regular track using an alignment bolt 42 at each end. Each length of rail 12 and the modified rail 20, includes a flange 36 at each end, which is positioned on the underside thereof. Along a centreline of the rail 12 or modified rail 20 is a hole, a threaded one at one end and a through-hole at the other. In this way, a regular length of rail 12 can be secured to the next length of rail 12, or as shown in FIG. 7, with the modified transfer rail 20, while maintaining alignment of the drive track 30. The alignment bolt 42, when tightened, secures the modified transfer rail 20 and thus the transfer section 16 in place such that the raise climber 10 can move out of the drift A and into the raise R per usual operation.

Figure 1:
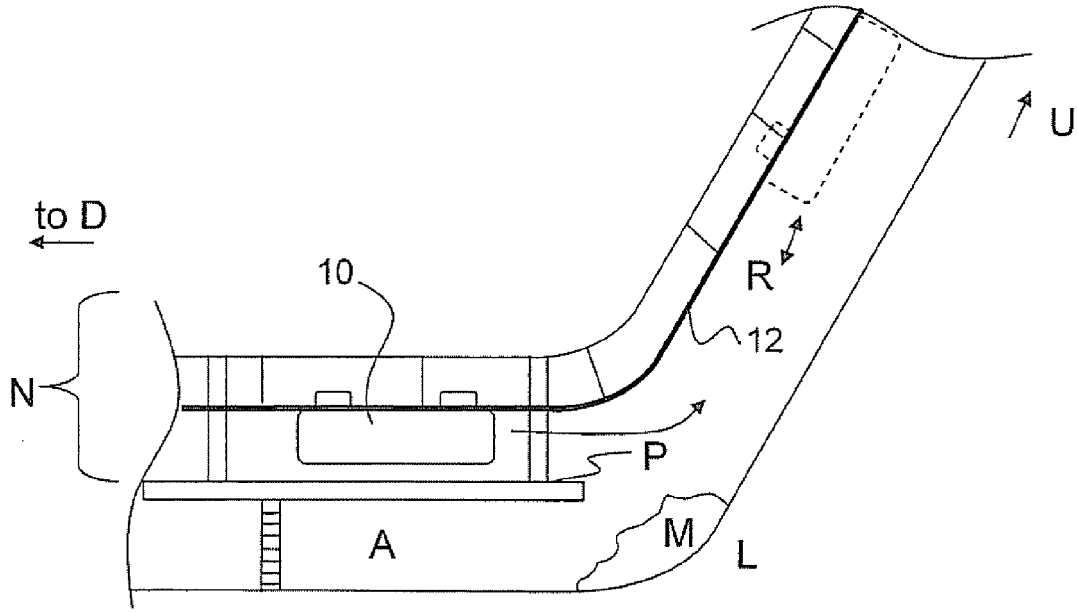
FIGURE 1 (PRIOR ART)
FIG. 1 is a schematic diagram showing a prior art nesting station for a raise climber.
Figure 2:
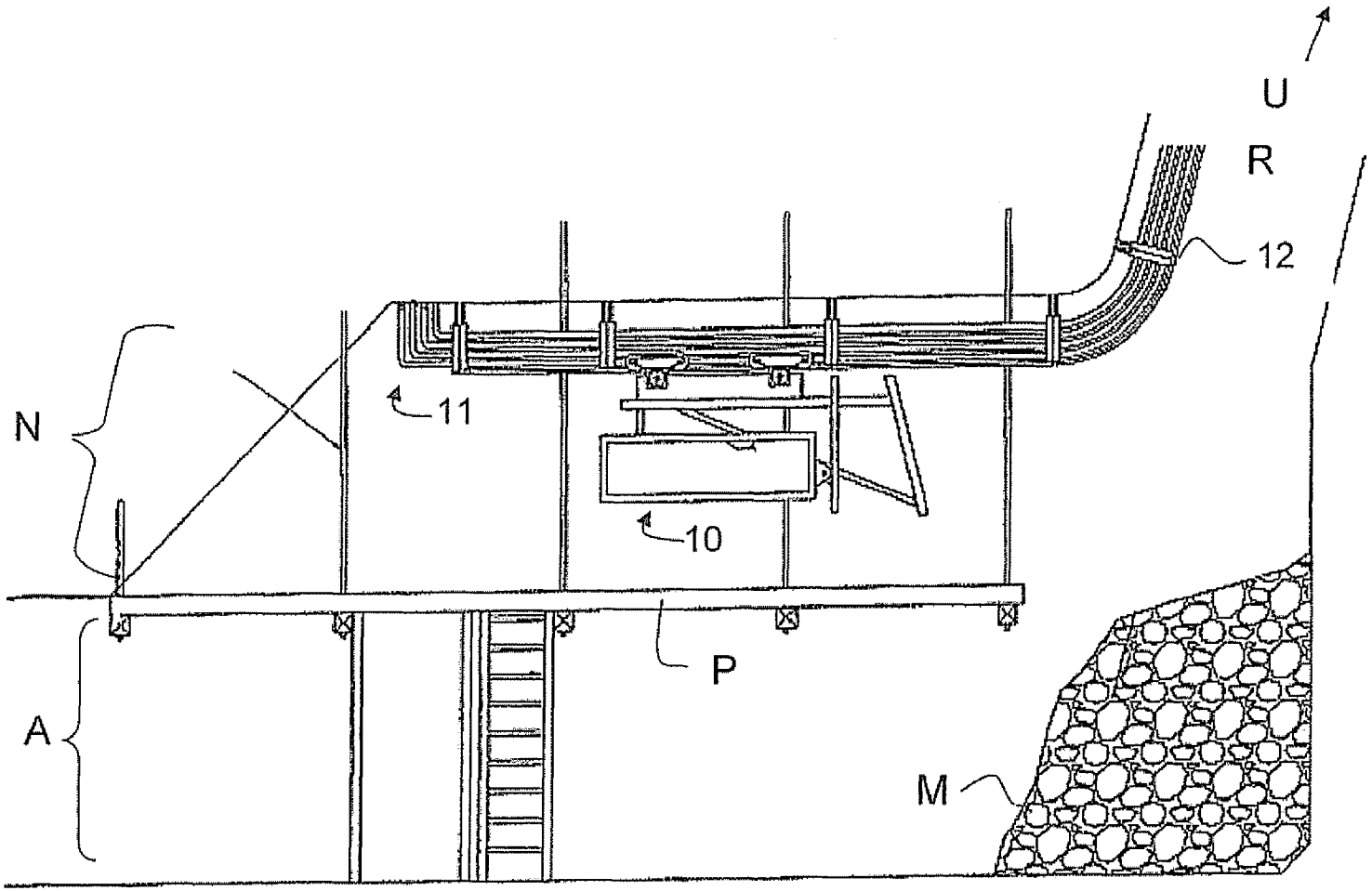
FIGURE 2 (PRIOR ART)
FIG. 2 is an enlarged view of the nesting station of FIG. 1.

In traditional raise climbing systems such as that shown in FIG. 1, and as noted above in discussion of FIG. 5, a series of services are fed along the rail 12 using a series of pipes 11. To avoid disrupting the services when using the side-cut 14 and transfer section 16, the service header 32 can be used, which directs the services and pipes 11 into the rail 12 ahead of the transfer section 16 as also shown in FIG. 6. In this way, as the transfer section 16 is moved into and out of alignment with the rail 12, the creation of a gap in the service piping 11 is avoided. The service header 32 is interposed between the transfer section 16 and the remaining rail 12 as shown in FIG. 6.

Figure 10:
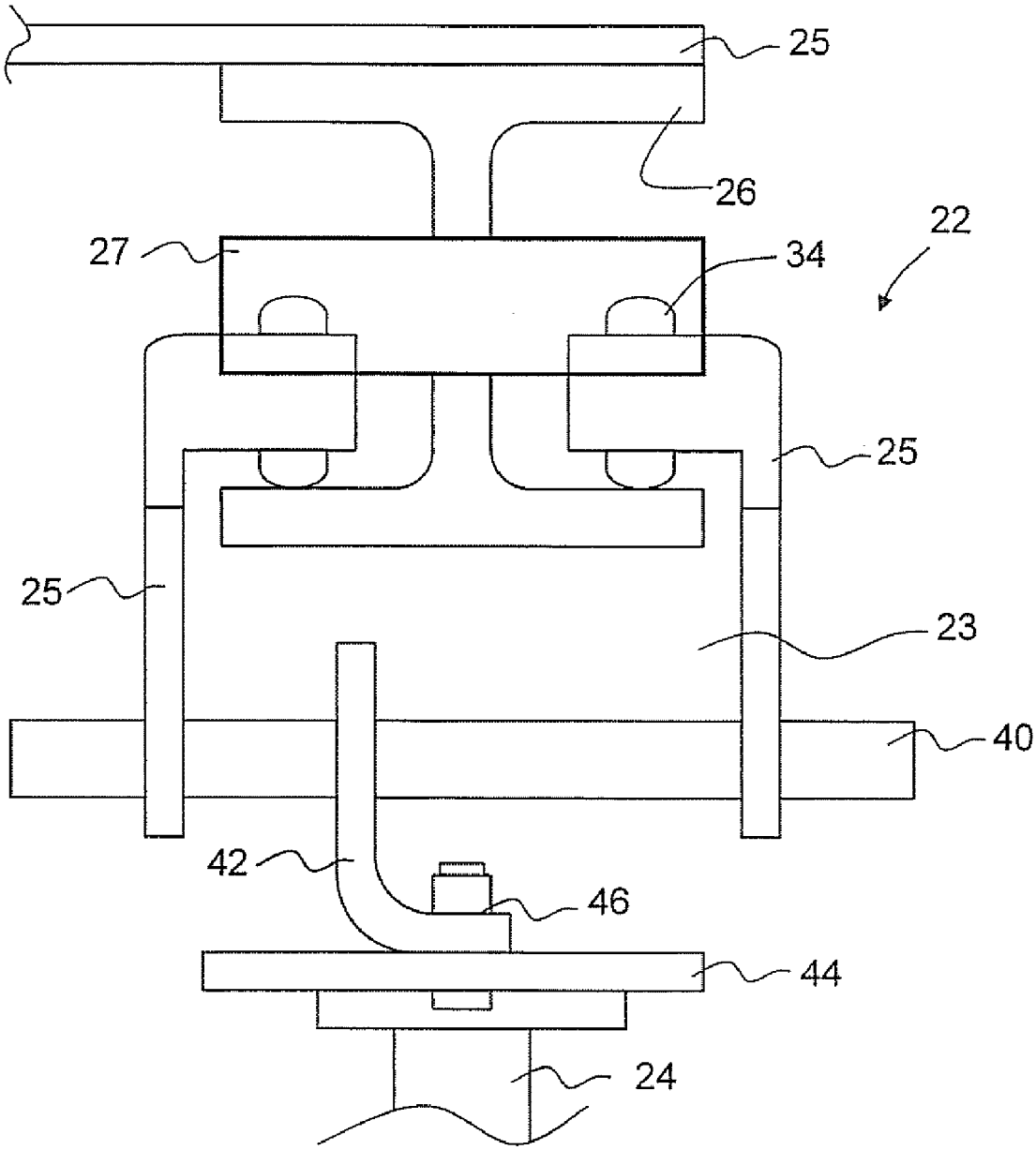
FIG. 10 is an enlarged end elevation view of the portion B shown in FIG. 6.
Figure 11:
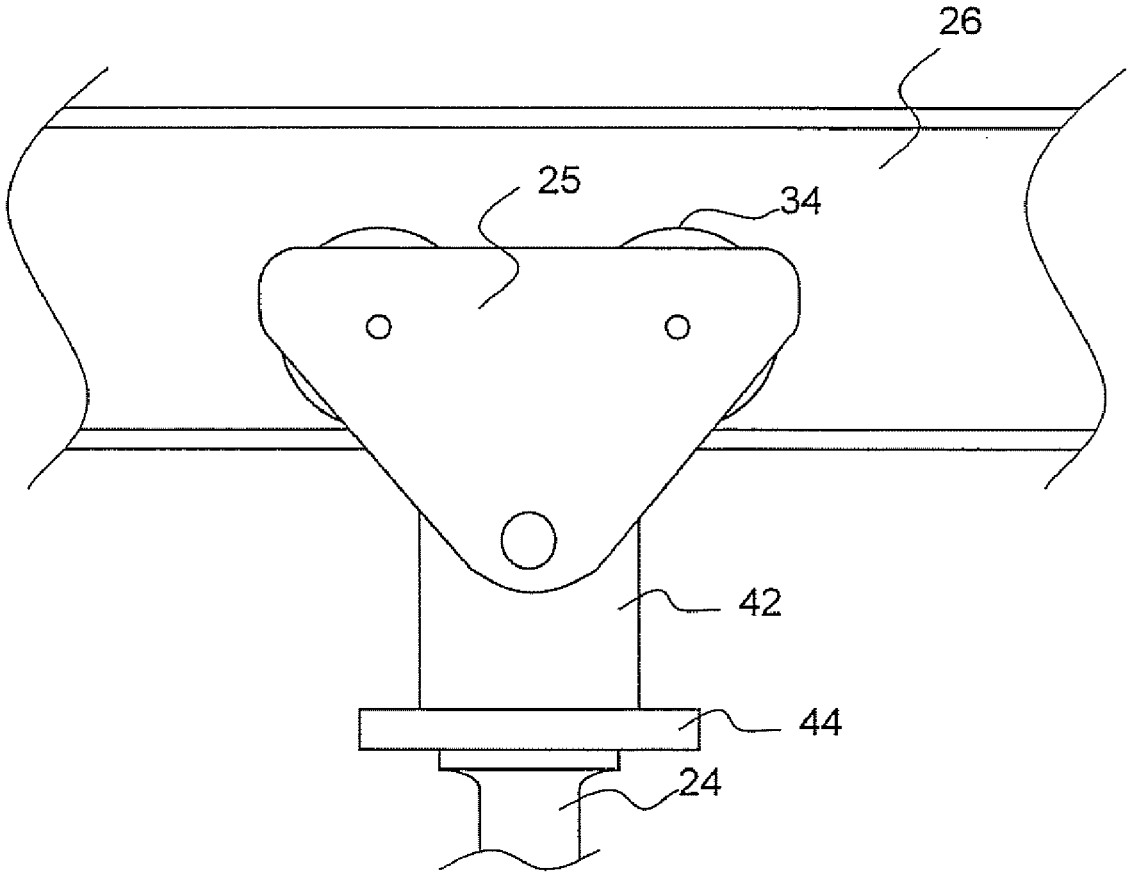
FIG. 11 is side elevation view of the portion shown in FIG. 10.

Turning now to FIGS. 10 and 11, further detail of the non-powered trolleys 22 is shown. Each trolley 22 includes a pair of arms 25 connected and spaced from each other using a shaft 40. The arms 25 define a central channel 23 to allow passage of the lower tracks of the transfer rail 26 therebetween as the trolley 22 moves into and out of the side-cut 14. The arms 25 also provide supports for mounting a set of trolley wheels 34. The trolley wheels 34 are mounted on the alms 25 such that they ride along the upper surface of the tracks provided by the transfer rails 26, with the shaft 40 and modified rail 20 suspended beneath the wheels 34. It has been found that a set of four trolley wheels 34 (with a set of three trolleys 22, 22' as shown) is sufficient to support the weight of a typical raise climber 10 (e.g. two wheels 34 per arm 25 as shown in FIG. 11). However, it will be appreciated that additional trolley wheels 34 and/or additional trolleys 22 and corresponding transfer rails 26 may be added to accommodate heavier equipment or to provide further carrying capacity and stability. Also, as discussed above, one or two transfer rails 26 with corresponding trolleys 22 can be used if sized and structured for adequate strength and stability when moving the raise climber 10 into and out of the side-cut 14. It can therefore be seen that the transfer section 16 and monorails 26 can be arranged in any number of ways. In order to suspend the modified rail 20 below the aims 25, the shaft 40 is used in this example to suspend a bracket 42, which is bolted 46 to an upper platform 44 formed with or attached to (e.g. welded to) the support 24 which, as discussed above, is in turn attached to the modified rail 20.

Figure 12:
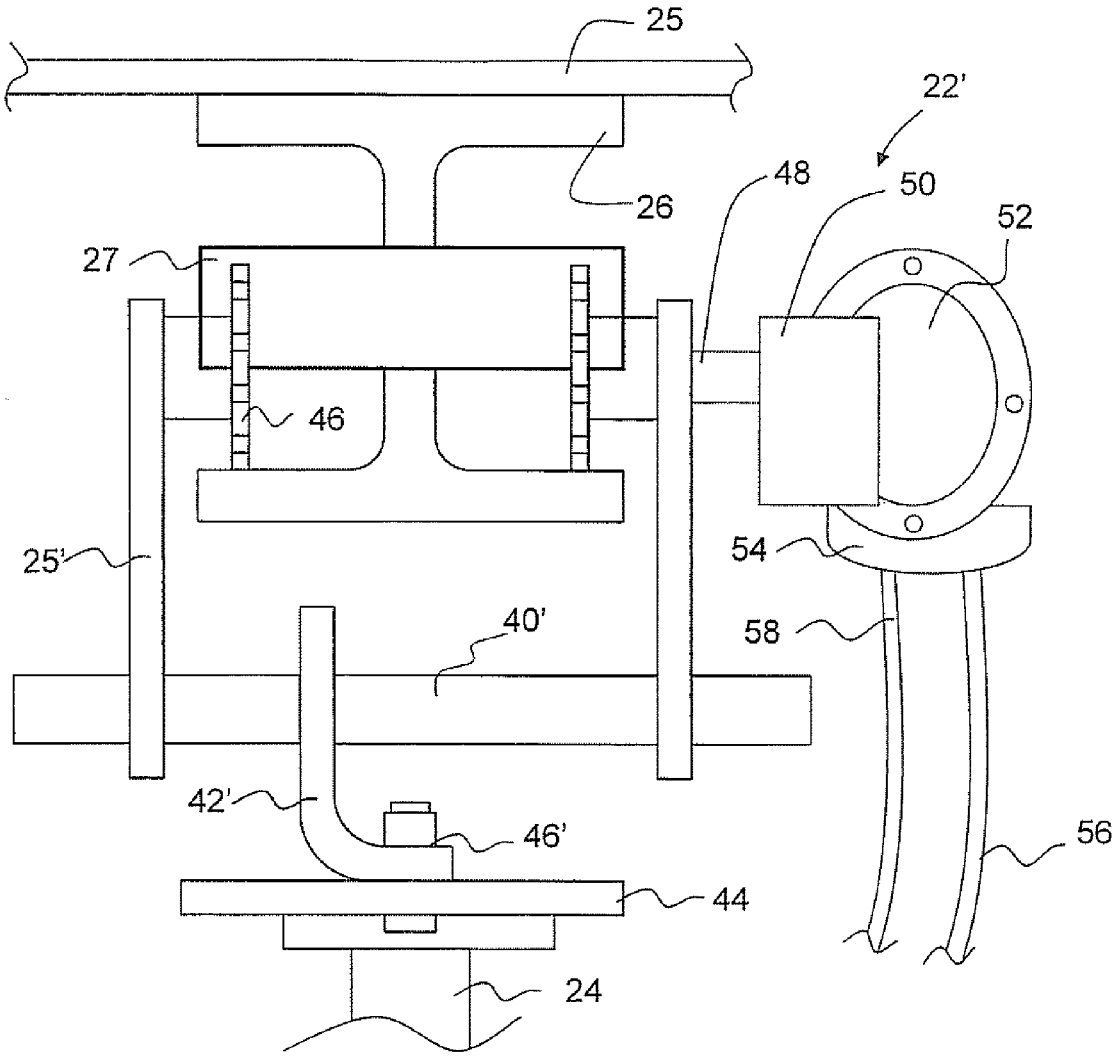
FIG. 12 is an enlarged end elevation view of the portion C shown in FIG. 6.
Figure 13:
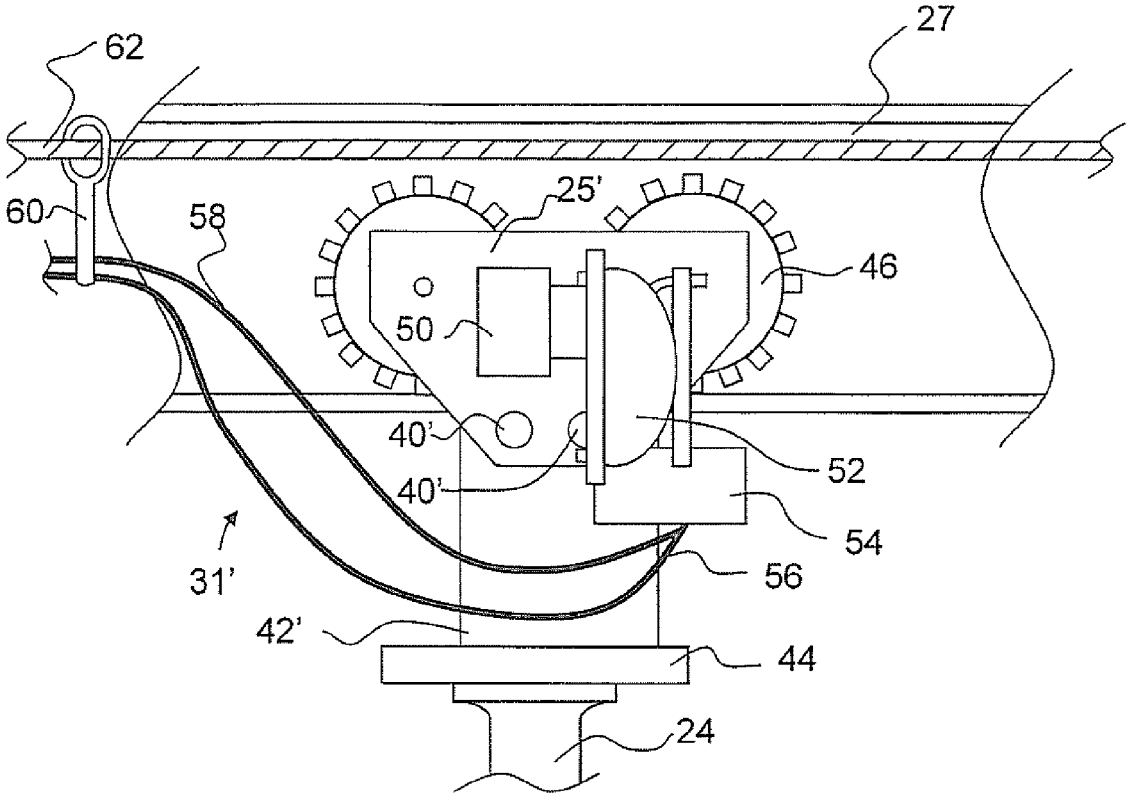
FIG. 13 is a side elevation view of the portion shown in FIG. 12.

FIGS. 12 and 13 provide further detail of the powered trolley 22' wherein similar elements with respect to FIGS. 10 and 11 are given like numerals with a prime (') and same elements are given like numerals. The powered trolley 22' includes a similar pair of arms 25' to support a set of drive wheels 46, which is this example are toothed such that they can be driven by a drive motor 50. In this example, a pair of shafts 40' are used to support and space the arms 25' and a similar bracket 42' is adapted accordingly to accommodate such shafts 40'. The drive motor 50 in this example is air powered and is controlled by a transmission 52, for which air is provided through an air manifold 54. A forward drive air line 56 and a reverse drive air line 58 are attached to the manifold 54. The forward line 56, when actuated, drives the trolley 22' into the side-cut 14 and the reverse line 58, when actuated, drives the trolley 22' out of the side-cut.

To avoid obstructing the movement of the transfer section 16, the air lines 56, 58 can be bundled using a tie 60 that can be adapted to be tethered to a cable 62 suspended laterally across the access drift A and side-cut 14. As discussed, any suitable drive system can be used and the air supplied system is shown for illustrative purposes only. Also, a drive system may not be required, e.g. if the raise climber 10 can be moved using external equipment or personnel. In such an alternative, a powered trolley 22' would not be required and instead, three non-powered trolleys 22 would suffice.

Figure 14:
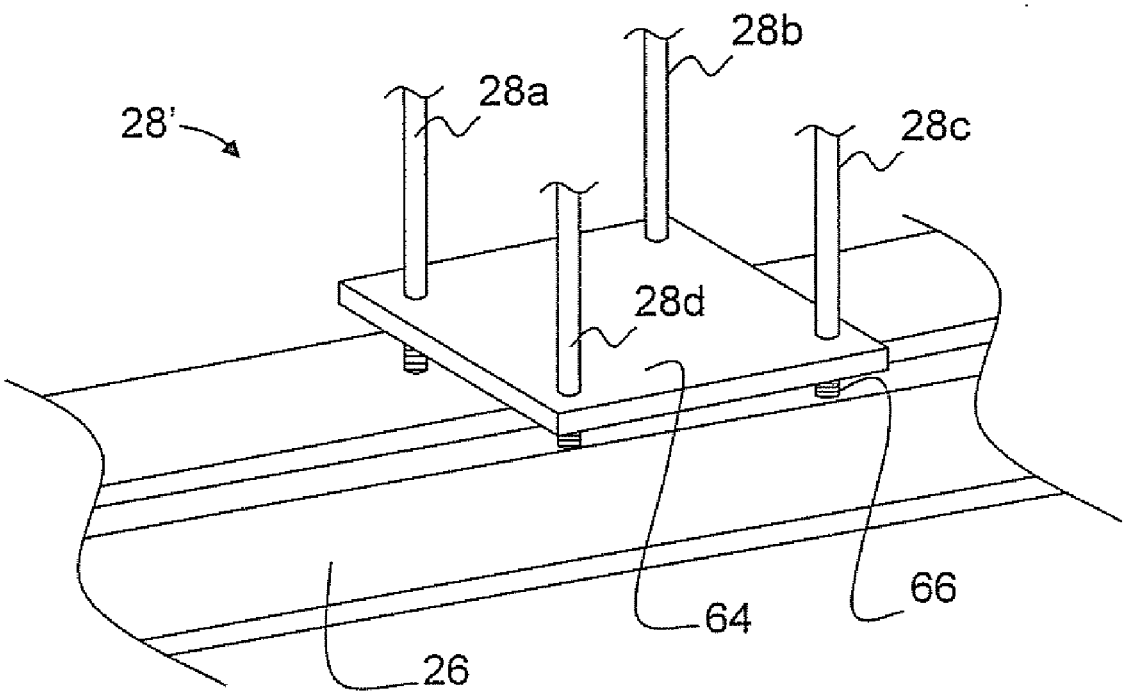
FIG. 14 is an enlarged perspective view of the portion D shown in FIG. 6.

As discussed above, the transfer rails 26 may be rock bolted to the back of the side-cut 14 using one or more rock bolts 28. It has been found that each rock bolt 28 shown in FIG. 6 is advantageously a set of rock bolts 28 providing the rock bolt assembly 28' as shown in FIG. 14. In this example, four rock bolts 28*a*, 28*b*, 28*c* and 28*d* are bolted 66 to a base plate 64 which is in turn attached, e.g. by welding, to the transfer rail 26. The rock bolt assembly 28' can include any number of rock bolts 28 and the set of four shown in FIG. 14 is for illustrative purposes only.

Once the side-cut 14 has been excavated at the appropriate location, the transfer rails 26 may then be installed such that they extend from the rail 12 to the innermost wall of the side-cut 14. The transfer rails 26 are suspended by a series of rock bolt assemblies 28' and rock bolted to the innermost wall of the side-cut 14. The transfer rails 26 should be parallel to and level with each other and substantially perpendicular to the rail 12 passing through the drift A, to encourage axial alignment of the modified transfer rail 20 and the adjacent lengths of rail 12. The transfer section 16 may then be suspended from the transfer rails 26 by sliding the tracks of the bottom portion of the I-beams through the central channel 23 such that the wheels 34, 34' sit atop the tracks as shown in FIGS. 10 and 12.

The transfer section 16, when suspended from the transfer rails 26, is free to slide into and out of the side-cut 14, with the raise climber 10 suspended from the transfer section 16, as shown in FIG. 5. To then start the raise R, the transfer section 16 is secured in line with the rail 12 using the alignment bolts 42. The raise climber 10 may then move from the transfer section 16, along the rail 12, and into the raise R. As per usual operation, the crew would drive the raise climber 10 to the face of the raise R, drill off a round of holes, load the holes with explosives, and then return the raise climber 10 to the drift A. The raise climber 10 is then parked on the modified transfer rail 20, the alignment bolts 42 removed, and the transfer section 16 shifted laterally into the side-cut 14 along the transfer rails 26, and thus out of the access drift A. The explosives may then be detonated and the muck pile removed. During detonation and muck removal, the raise climber 10 is safely parked away from falling debris and other hazards. When the access drift A is clear, the transfer section 16 and parked raise climber 10, can be moved together out of the side-cut 14 and in line with the rail 12. The alignment bolts 42 are then reattached and the raise climber 10 can repeat the blasting or other work performed in the raise R.

It can be appreciated that once the raise R is completely excavated and the raise climber 10 no longer needed, the side-cut 14 can be reused for electrical services, storage, shelter etc. The pilot drift A does not need to be enlarged to accommodate the suspended timber decking and ladder and thus the inherent added instability is avoided.

It can therefore be seen that the added instability, expense and effort associated with the additional excavation N as well as the additional cost of the timber, hanging rods and ladder access required to install a parking area P used in the prior art can be avoided by using the system discussed above, in particular by excavating a side-cut 14 into a side wall of the pilot or access drift A and providing a transfer rail 20 to shift the raise climber 10, when parked, into the side-cut 14. In this way, the instability created by further excavation of the access drift A is avoided. Moreover, the side-cut 14 enables a raise climber 10 to be shifted out of the access drift A and in turn out of the way of mucking equipment, avoiding the need for another drift in order to access the bottom of the raise R for muck removal. It has been found that the side-cut 14 is particularly suitable for mine environments such as those shown in FIG. 1-3 where only a single access drift A provides access to the raise R. Additionally, all items use to create the system described above can be reused at the next setup site with the exception of the rock bolts thus enabling this configuration to be reused.

Although the invention has been described with reference to certain specific embodiments, various modifications thereof will be apparent to those skilled in the art.

The invention claimed is:

1. A transfer assembly for laterally transferring a raise climber out of an access drift, said access drift extending away from a lower end of a raise, said transfer assembly comprising:

a length of rail being sized to fit in series with, and in between, a pair of existing rails supported in said access drift and spaced from each other, to provide continuity between the existing rails and said length of rail and thereby permit said raise climber to drive from said length of rail onto either of said existing rails;

one or more supports attached to and extending upwardly from said length of rail and positioned along said length of rail to be aligned with corresponding transfer rails extending away from said access drift and into a recess in said access drift; and a trolley at an upper end of each support, each support being sized to provide vertical alignment of a respective trolley with a corresponding transfer rail when said transfer assembly is aligned with said existing rails, each trolley being configured to suspend from, and be moveable along, said corresponding transfer rail, to permit movement of said transfer assembly laterally with respect to said existing rail and into said recess.

2. The assembly according to claim 1 further comprising one or more of said transfer rails configured to be suspended from a back in said recess.

3. The assembly according to claim 2 comprising at least two transfer rails and further comprising at least one cross-beam attached to said at least two transfer rails.

4. The assembly according to claim 2 wherein said one or more transfer rails are suspended from said back using rock bolts.

5. The assembly according to claim 4 comprising a series of rock bolt assemblies for each transfer rail, each rock bolt assembly comprising a plurality of rock bolts sized to extend from said transfer rails to said back.

6. The assembly according to claim 2 comprising three transfer rails, three corresponding trolleys and three corresponding supports in alignment with each other.

7. The assembly according to claim 1 further comprising at least one alignment bolt for securing said length of rail to said existing rails.

8. The assembly according to claim 1 further comprising a service manifold configured to fit between said length of rail and said existing rails to redirect mine services.

9. The assembly according to claim 1 wherein one of said one or more trolleys is powered by a drive system.

10. The assembly according to claim 9 wherein said drive system is air powered and comprises a control box for controlling movement of said powered trolley along a corresponding transfer rail.

11. The assembly according to claim 10 wherein air supply lines for said drive system are tethered to a cable for guiding said air supply lines during movement of said transfer assembly.

12. A method for modifying an access drift in a mine to incorporate a parking area for a raise climber, said access drift extending away from a lower end of a raise, said method comprising:

installing in a recess in said access drift, one or more transfer rails extending from a discontinuity between a pair of existing rails supported in said access drift, and away from said access drift and into said recess, said pair of existing rails being spaced end to end from one another to provide said discontinuity;

providing a length of rail sized to fit in series with, and in between said pair of existing rails in said discontinuity, to provide continuity between said existing rails and said length of rail, and thereby permit said raise climber to drive from said length rail onto either of said existing rails;

providing one or more supports extending upwardly from said length of rail and positioned along said length of rail to be aligned with corresponding transfer rails;

providing a trolley on each support, each trolley configured to suspend from and be moveable along said corresponding transfer rail; and suspending said length of rail from said transfer rails by suspending each trolley from a corresponding transfer rail.

13. The method according to claim 12 wherein said installing comprises rock bolting said transfer rails to a back of said recess.

14. The method according to claim 12 wherein one of said trolleys comprises a drive system.

15. The method according to claim 14 wherein said drive system is air powered and further comprising providing an air supply to said drive system and providing a control box for controlling movement of said powered trolley along a corresponding transfer rail.

16. The method according to claim 15 further comprising tethering said air supply to a cable for guiding said air supply during movement of said transfer assembly.

* * * * *